US007468718B2

(12) United States Patent
Shin

(10) Patent No.: US 7,468,718 B2
(45) Date of Patent: Dec. 23, 2008

(54) DEMULTIPLEXER AND DISPLAY DEVICE USING THE SAME

(75) Inventor: Dong-Yong Shin, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 713 days.

(21) Appl. No.: 10/971,177

(22) Filed: Oct. 22, 2004

(65) Prior Publication Data

US 2005/0119867 A1 Jun. 2, 2005

(30) Foreign Application Priority Data

Nov. 27, 2003 (KR) ..... 10-2003-0085134

(51) Int. Cl.
*G09G 3/36* (2006.01)

(52) U.S. Cl. ..... 345/98

(58) Field of Classification Search ..... 345/76, 345/98–100

See application file for complete search history.

(56) References Cited

U.S. PATENT DOCUMENTS

| | | | | |
|---|---|---|---|---|
| 6,097,362 | A | 8/2000 | Kim | |
| 6,963,336 | B2 | 11/2005 | Kimura | |
| 7,180,497 | B2 * | 2/2007 | Lee et al. | 345/98 |
| 7,193,593 | B2 * | 3/2007 | Koyama et al. | 345/87 |
| 2006/0119552 | A1 | 6/2006 | Yumoto | |

FOREIGN PATENT DOCUMENTS

| | | |
|---|---|---|
| CN | 1432989 | 7/2003 |
| JP | 2-306293 | 12/1990 |
| JP | 6-118913 | 4/1994 |
| JP | 11-133949 | 5/1999 |
| WO | WO 02/39420 A1 | 5/2002 |
| WO | WO 03/038797 A1 | 5/2003 |

* cited by examiner

*Primary Examiner*—Amr Awad
*Assistant Examiner*—Randal Willis
(74) *Attorney, Agent, or Firm*—Christie, Parker & Hale, LLP

(57) ABSTRACT

A display device including a data driver for supplying data currents corresponding to image signals, and a demultiplexer including first and second sample/hold circuit groups having input terminals coupled to the data driver. Each said sample/hold circuit group includes at least two sample/hold circuits. The display device also includes a switch unit for switching between output terminals of the first and second sample/hold circuit groups and data lines, and a scan driver for supplying select signals to scan lines. One of the sample/hold circuits of the first sample/hold circuit group samples a corresponding one of the data currents during at least a part of a period in which another one of the sample/hold circuits of the first sample/hold circuit group outputs a current to the switch unit. Orders in which the data currents are supplied from the data driver are varied.

39 Claims, 15 Drawing Sheets

DEMULTIPLEXER AND DISPLAY DEVICE USING THE SAME

CROSS REFERENCE TO RELATED APPLICATION

This application claims priority to and the benefit of Korea Patent Application No. 10-2003-0085134 filed on Nov. 27, 2003 in the Korean Intellectual Property Office, the entire content of which is incorporated herein by reference.

BACKGROUND OF THE INVENTION (a) Field of the Invention

The present invention relates to a display device. More specifically, the present invention relates to a demultiplexer for demultiplexing a data current in a display device.

(b) Description of the Related Art

FIG. 1 shows an active matrix organic light emitting diode (AMOLED) display device as an example of a current driven display device which needs current demultiplexing.

The current driven display device includes an organic electroluminescent (EL) display panel 100, a data driver 200 for providing a data current, a current demultiplexer 300 for performing 1:N demultiplexing on the data current, and scan drivers 400 and 500 for sequentially selecting a plurality of scan lines.

A predetermined data current is applied to pixels 10 coupled to scan lines selected by the scan drivers 400 and 500, and the pixels 10 display colors corresponding to the data current. The current demultiplexer 300 is used so as to reduce the number of integrated circuits (ICs) of the data driver. That is, the current provided by the data driver 200 is 1:N-demultiplexed by the demultiplex unit 300, and is applied to the pixels corresponding to the N data lines data[1] to data[n]. Usage of the current demultiplexer 300 reduces the number of ICs necessary for the data driver and saves purchase costs.

FIG. 2 shows a conventional analog switch for a demultiplexer.

The 1:2 demultiplexer shown in FIG. 2 alternately switches the switches S1 and S2 to thereby output the data current to two data lines. A long time is required to program the data to the pixels 10 in order to realize high resolution in the current driven panel. When such conventional demultiplexing scheme is used to reduce the number of ICs of the data driver, however, the data programming time needs to be reduced since the data are to be programmed to the pixels each time the switches are alternately switched. Therefore, the conventional demultiplexer is not suitable for high-resolution display devices.

SUMMARY OF THE INVENTION

In exemplary embodiments according to the present invention, is provided a demultiplexing device and method for reducing the number of ICs of the data driver without reducing the data programming time.

Further, in exemplary embodiments according to the present invention, is provided a demultiplexing device and method appropriate for high-resolution display devices.

In addition, in exemplary embodiments according to the present invention, is provided a demultiplexing device and method to be controlled by clock signals without an additional logic device for generating control signals applied to a demultiplexer.

In one aspect of the present invention, a display device including a plurality of data lines for transmitting data currents corresponding to image signals, a plurality of scan lines for transmitting select signals, and a plurality of pixel circuits coupled to the data lines and the scan lines, is provided. The display device includes a data driver for supplying the data currents corresponding to the image signals, and a demultiplexer including first and second sample/hold circuit groups having input terminals coupled to the data driver. Each said sample/hold circuit group includes at least two sample/hold circuits. The display device also includes a switch unit for switching between output terminals of the first and second sample/hold circuit groups and the data lines, and a scan driver for supplying the select signals to the scan lines. One of the sample/hold circuits of the first sample/hold circuit group samples a corresponding one of the data currents during at least a part of a period in which another one of the sample/hold circuits of the first sample/hold circuit group outputs a current to the switch unit. One of the sample/hold circuits of the second sample/hold circuit group samples a corresponding one of the data currents during at least a part of a period in which another one of the sample/hold circuits of the second sample/hold circuit group outputs a current to the switch unit. Orders in which the data currents are supplied from the data driver are varied.

In another aspect of the present invention, a display device including a plurality of data lines for transmitting data currents corresponding to image signals, a plurality of scan lines for transmitting select signals, and a plurality of pixel circuits coupled to the data lines and the scan lines, is provided. The display device includes a data driver for supplying the data currents corresponding to the image signals, and a demultiplexer having an input terminal coupled to the data driver, and demultiplexing the data currents to output as demultiplexed data currents. The display device also includes a switch unit for switching between an output terminal of the demultiplexer and the data lines, and a scan driver for supplying the select signals to the scan lines. Orders of the data currents supplied from the data driver are established differently in at least two different frames, and the switch unit is switched so that the demultiplexed output currents are programmed to corresponding said pixel circuits.

In yet another aspect of the present invention, a demultiplexer for programming time-divided, input data currents to at least two signal lines, is provided. The demultiplexer includes first and second sample/hold circuit groups each having an input terminal coupled to a data driver, and demultiplexing the input data currents to output as demultiplexed currents, and a switch unit for switching between output terminals of the first and second sample/hold circuit groups and the signal lines. The first sample/hold circuit group includes first and third sample/hold circuits each having an input terminal and an output terminal, wherein the input terminals of the first and third sample/hold circuits are coupled with each other, and the output terminals of the first and third sample/hold circuits are coupled with each other. The second sample/hold circuit group includes second and fourth sample/hold circuits each having an input terminal and an output terminal, wherein the input terminals of the second and fourth sample hold circuits are coupled with each other, and the output terminals of the second and fourth sample/hold circuits are coupled with each other. Sampling orders of the first, second, third and fourth sample/hold circuits are varied according to orders of the input data currents.

In still another aspect of the present invention, a demultiplexing method for outputting time-divided and sequentially input data currents to at least two signal lines, is provided. First and second sample/hold circuits are allowed to sequentially sample the input data currents to store as first sampled data in a predetermined order during a first period. The first and second sample/hold circuits are allowed to hold a current corresponding to the first sampled data to the signal lines, and third and fourth sample/hold circuits are allowed to sample the input data currents to store as second sampled data during a second period. The third and fourth sample/hold circuits are allowed to hold a current corresponding to the second sampled data to the signal lines during a third period. Orders of the input data currents are varied.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
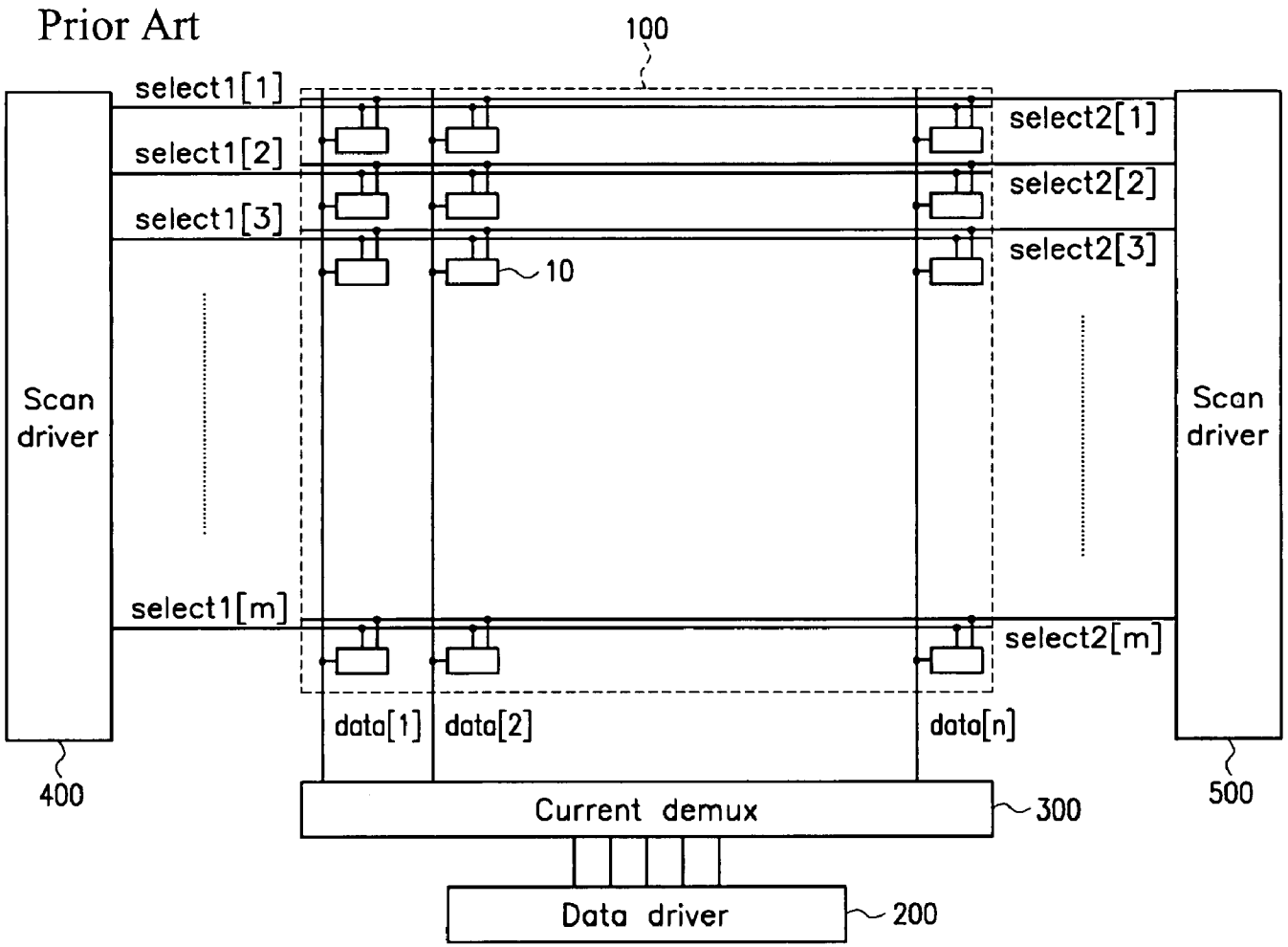
FIG. 1 shows an AMOLED display device as an example of a current driven display device, which may use current demultiplexing according to exemplary embodiments of the present invention.
Figure 2:
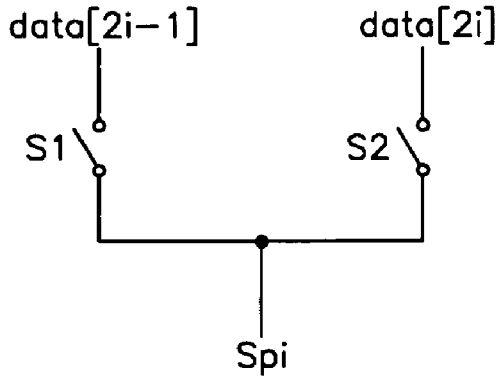
FIG.2 Prior Art
FIG. 2 shows a conventional demultiplexer having analog switches.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive.

The term "couple" or the phrase such as "coupling one thing to another" refer to both directly coupling a first one to a second one and coupling the first one to the second one through a third one, which is provided therebetween. To clarify the present invention, parts which are not described in the specification may have been omitted, and like elements are designated by like reference numerals.

Figure 3:
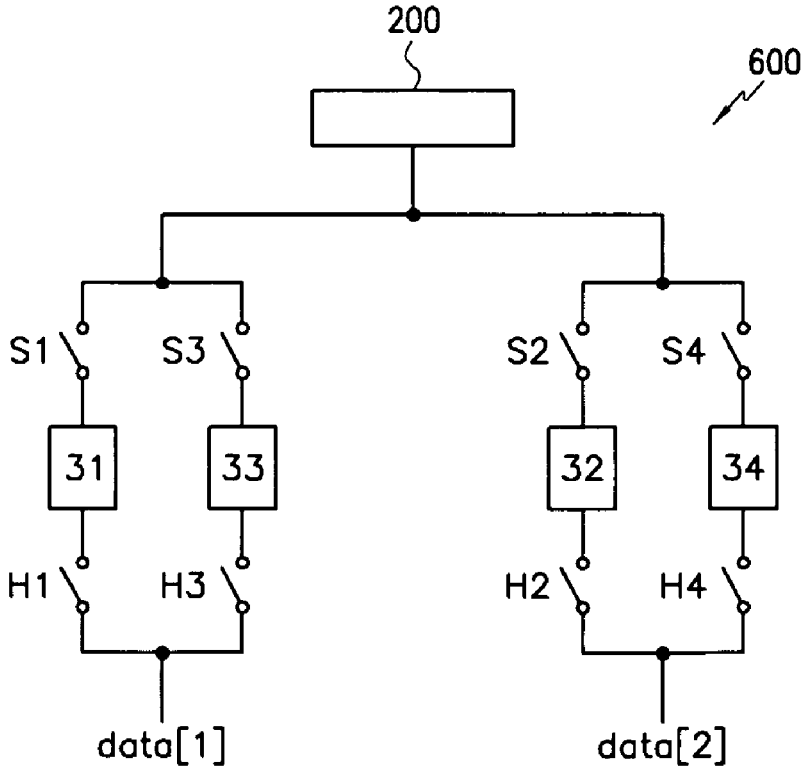
FIG. 3 shows a conceptual block diagram of a demultiplexer according to a first exemplary embodiment of the present invention.

FIG. 3 shows a conceptual block diagram of a demultiplexer 600 according to a first exemplary embodiment of the present invention. By way of example, the demultiplexer 600 may be used as the demultiplexer 300 of FIG. 1.

As shown, the demultiplexer 600 uses four sample/hold circuits which include data storage units 31, 32, 33, and 34; sampling switches S1, S2, S3, and S4; and holding switches H1, H2, H3, and H4. The data storage units 31, 32, 33, and 34 are coupled to a data driver 200 through the sampling switches S1, S2, S3, and S4, respectively, and coupled to the data lines data[1] and data[2] through the holding switches H1, H2, H3, and H4, respectively.

The terminologies of "to sample" and "to hold" used in the specification will now be defined.

The sample/hold operation includes an operation for sampling the current flowing through the input terminal and writing it in the data storage units in the voltage format, a state for maintaining the written data and standing by since the input switches and the output switches are turned off, and an operation for supplying ("holding") the current of the data lines by using the values corresponding to the written data. The above-noted stages can be referred to, respectively, as a "sampling" stage, a "standby" stage, and a "holding" stage based on the operations performed therein, for better clarification.

The internal configuration of the sample/hold circuit according to the exemplary embodiment will now be described in detail. Since the four sample/hold circuits used in the demultiplexer 600 are substantially identically realized, one sample/hold circuit will be described hereinafter.

Figure 4A:
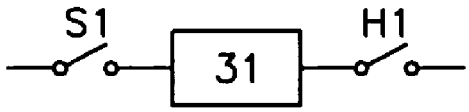
FIG. 4A shows a first sample/hold circuit according to the first exemplary embodiment of the present invention.
Figure 4B:
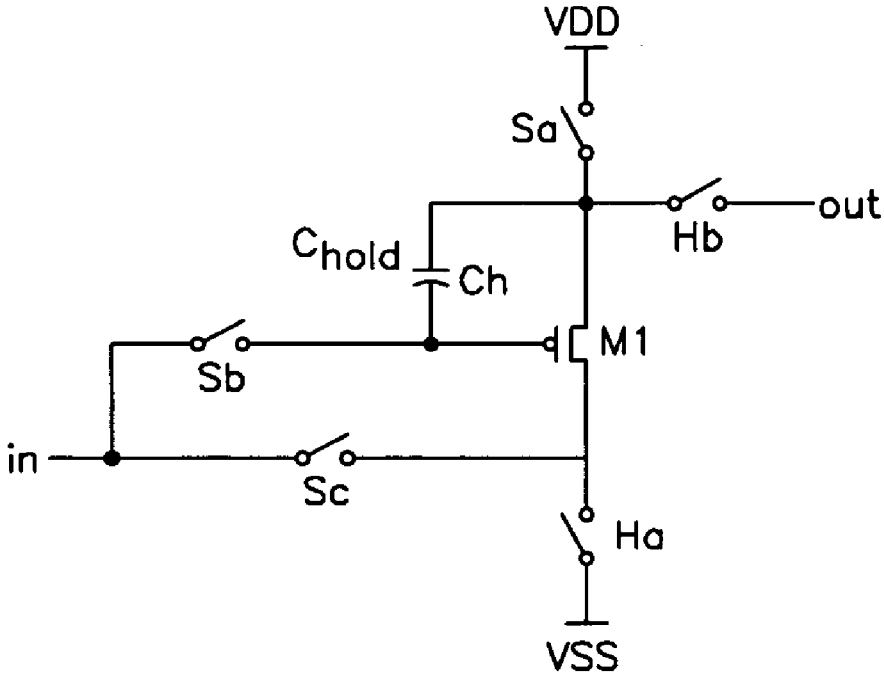
FIG. 4B shows an equivalent circuit of the circuit shown in FIG. 4A.

FIG. 4A shows a first sample/hold circuit according to a first exemplary embodiment, and FIG. 4B shows an equivalent circuit of the circuit shown in FIG. 4A.

The first sample/hold circuit includes a transistor M1, a capacitor Ch, sampling switches Sa, Sb, and Sc, and holding switches Ha and Hb as shown in FIG. 4B.

The sampling switches Sa, Sb, and Sc represent the switch S1 of FIG. 4A, and they are controlled by substantially identical control signals. The holding switches Ha and Hb respectively represent the switch H1 of FIG. 4A, and they are controlled by substantially identical control signals.

The sampling switch Sa is coupled between a power supply source VDD and a source of the transistor M1, and the holding switch Ha is coupled between a power supply source VSS and a drain of the transistor M1. A first terminal of the sampling switch Sb is coupled to a gate of the transistor M1, a second terminal thereof is coupled to a first terminal of the sampling switch Sc, and a second terminal of the sampling switch Sc is coupled to the drain of the transistor M1. Hence, the transistor M1 is diode-connected when the sampling switches Sb and Sc are both turned on.

An operation of the first sample/hold circuit will now be described in reference to FIGS. 3, 4A and 4B.

When the sampling switches Sa, Sb, and Sc are turned on and the holding switches Ha and Hb are turned off, the gate and the source of the transistor M1 are coupled to thus form a diode connection, and the current flows to the data driver 200 through the transistor M1 from the power supply source VDD. The capacitor Ch is charged with a gate-source voltage which corresponds to the current flowing to the transistor M1, and the first sample/hold circuit performs a sampling operation of the data.

When the sampling switches Sa, Sb, and Sc and the holding switches Ha and Hb are turned off, the first sample/hold circuit enters the standby stage while another sample/hold circuit of the demultiplexer 600 holds the data to the data lines.

When the sampling switches Sa, Sb, and Sc are turned off and the holding switches Ha and Hb are turned on, the current which corresponds to the gate-source voltage charged in the capacitor Ch is maintained to flow to the drain from the source of the transistor M1. In this instance, the first sample/hold circuit performs a data programming operation, and holds the data through the data lines.

FIG. 4B illustrates the transistor M1 which is realized with a p channel transistor. In other embodiments, however, the transistor M1 can be realized with any suitable active element which has a first electrode, a second electrode, and a third electrode, and which controls the current flowing to the third electrode according to a voltage applied to the first and second electrodes.

FIG. 4B illustrates a single sample/hold circuit, but the scope of the present invention is not restricted to specific sample/hold circuits, and the scope thereof is applicable to demultiplexers which perform the demultiplexing operation to be subsequently described using the sample/hold circuits.

Figure 5:
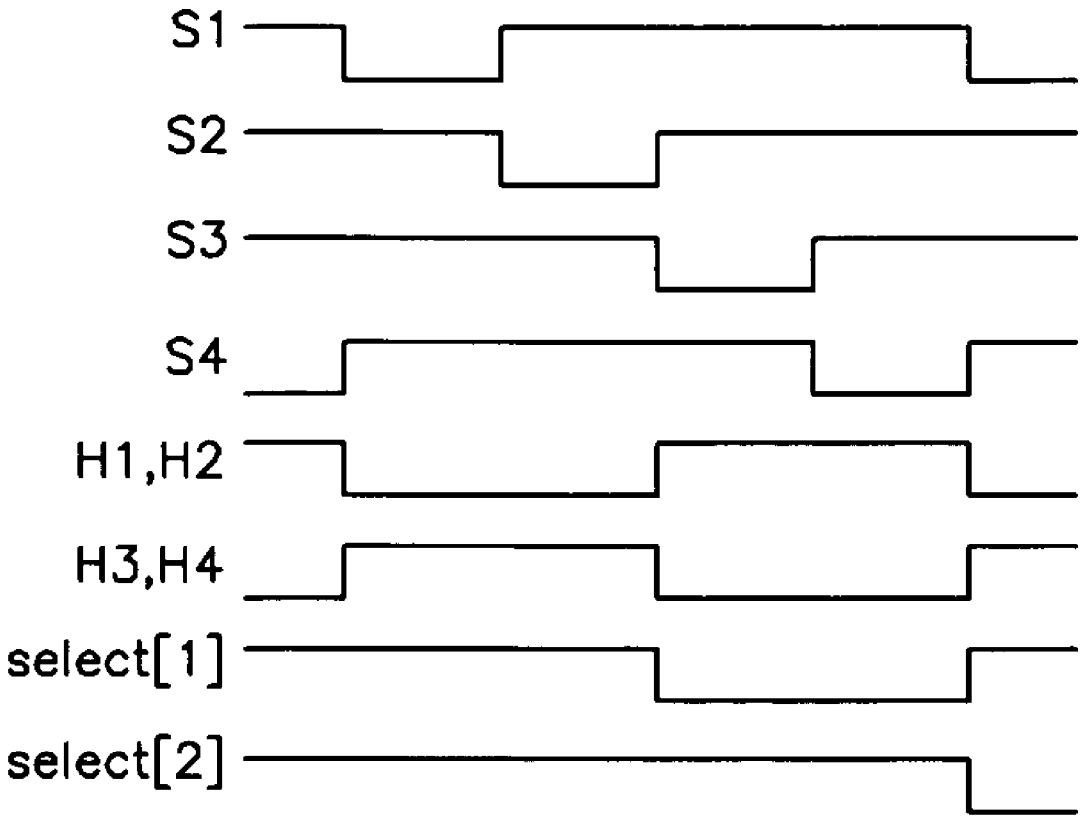
FIG. 5 shows a waveform of a control signal applied to a demultiplexer according to the first exemplary embodiment of the present invention.

Referring to FIG. 5, an operation of the demultiplexer 600 according to the first exemplary embodiment of the present invention will now be described.

FIG. 5 shows a waveform of a control signal applied to the demultiplexer 600 according to the first exemplary embodiment of the present invention. It is assumed below that the sampling switches S1, S2, S3, and S4 are turned on when the applied control signal is low, and the holding switches H1, H2, H3, and H4 are turned on when the applied control signal is high.

When the sampling switches S1 and S2 are sequentially turned on, the data storage units 31 and 32 input the data currents and perform a sampling operation. Further, when the sampling switches S3 and S4 are sequentially turned on, the data storage units 33 and 34 perform a sampling operation. At the same time, since a select signal Select[1] is applied and the holding switches H1 and H2 are turned on, the currents sampled by the data storage units 31 and 32 are held to the data lines data[1] and data[2] and are programmed to the pixels.

When the select signal Select[2] is applied and the holding switches H3 and H4 are turned on (not illustrated), the currents sampled by the data storage units 33 and 34 are held to the data lines data[1] and data[2] and are programmed to the pixels.

The above-noted operation is repeatedly performed, and the demultiplexer 600 demultiplexes the data current output from the data driver 200 and provides demultiplexed currents to the data lines data[1] and data[2].

The demultiplexer 600 according to the first exemplary embodiment allows an increased data programming time when two sample/hold circuits sequentially sample the data currents provided from the data driver 200, while other two sample/hold circuits hold the data through the data lines.

However, when the demultiplexer 600 according to the first exemplary embodiment is actually used, repeated spot patterns may be found on the display panel 100 because of characteristic differences of the four sample/hold circuits included in the demultiplexer 600 or the orders for sampling the data currents. In detail, the reason is that the currents held through the data lines are not the same even when the four sample/hold circuits sample the identical data currents.

To address this problem, in other exemplary embodiments, the four sample/hold circuits supply the data currents to the respective pixels the same number of times, and an average of the output currents of the four sample/hold circuits may be supplied to the pixels.

The average of the output currents of the four sample/hold circuits is supplied to the pixels in a second exemplary embodiment by repeating four frames which have different corresponding relations between the four sample/hold circuits and the pixels which receive the data currents from the four circuits.

Referring to FIGS. 6 to 10, a demultiplexer 700 according to the second exemplary embodiment will be described in detail.

Figure 6:
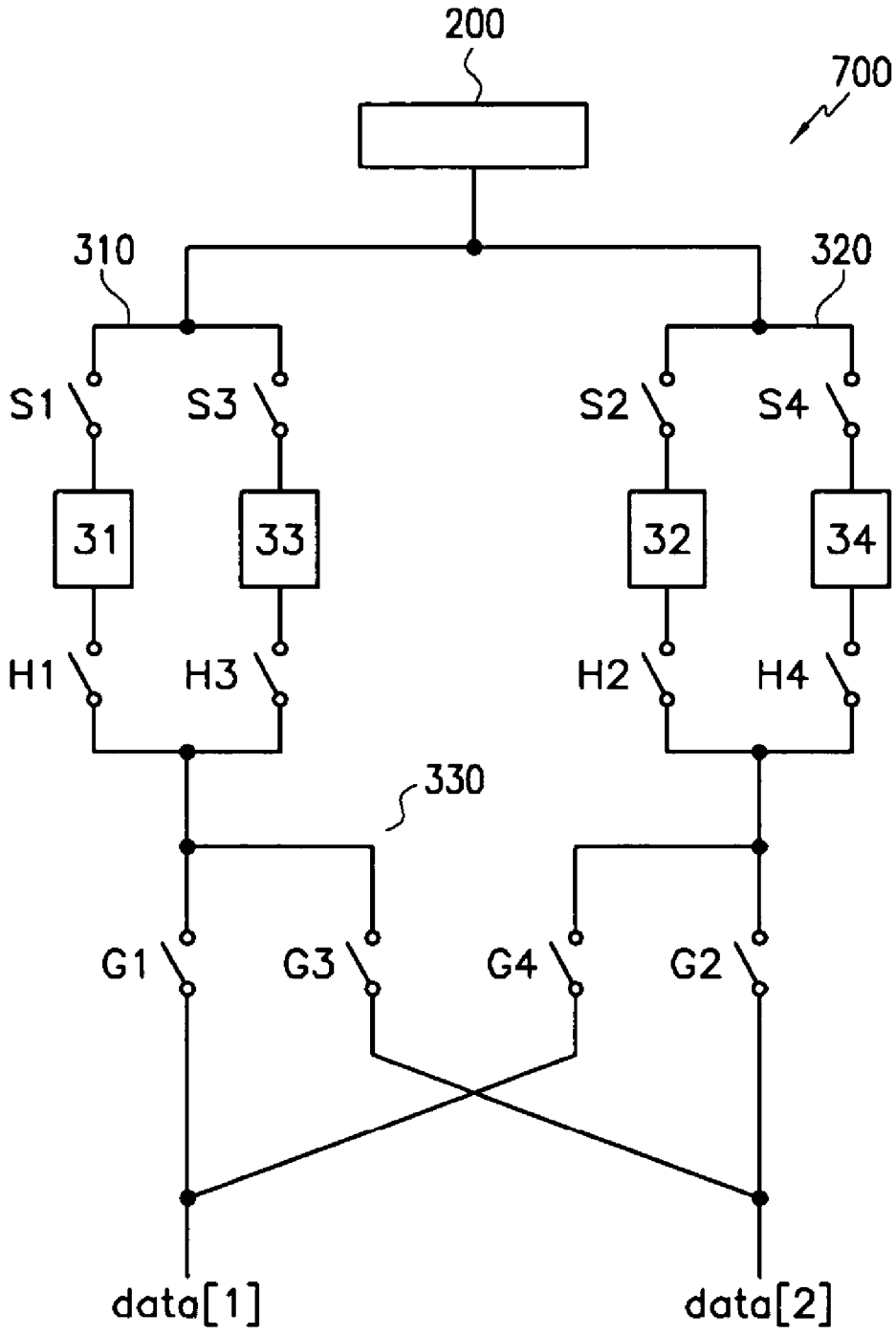
FIG. 6 shows a demultiplexer according to a second exemplary embodiment of the present invention.

FIG. 6 shows the demultiplexer 700 according to the second exemplary embodiment of the present invention. By way of example, the demultiplexer 700 may be used as the demultiplexer 300 of FIG. 1.

As shown, the demultiplexer 700 includes a first sample/hold circuit group 310, a second sample/hold circuit group 320, and a switch unit 330. The first sample/hold circuit group 310 includes first (1st) and third (3rd) sample/hold circuits including, respectively, the data storage unit 31 and the switches S1, H1 and the data storage unit 33 and the switches S3, H3. The second sample/hold circuit group 320 includes second (2nd) and fourth (4th) sample/hold circuits including, respectively, the data storage unit 32 and the switches S2, H2 and the data storage unit 34 and the switches S4, H4.

The first and second sample/hold circuit groups 310 and 320 demultiplex the data current provided from the data driver 200 and output results, and the switch unit 330 switches between output terminals of the first and second sample/hold circuit groups 310 and 320 and the data lines data[1] and data[2].

In more detail, the switch unit 330 includes four switches G1, G2, G3 and G4. The switch G1 is coupled between the holding switches H1, H3 and the data line data[1], and the switch G3 is coupled between the holding switches H1, H3 and the data line data[2]. Further, the switch G2 is coupled between the holding switches H2, H4 and the data line data [2], and the switch G4 is coupled between the holding switches H2, H4 and the data line data[1]. This way, the switch unit 330 can provide holding current from each of the first and second sample/hold circuit groups 310 and 320 to either the data line data[1] or to the data line data[2] depending on the state of the switches G1, G2, G3 and G4.

Figure 7:
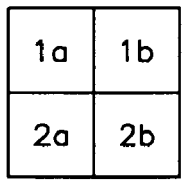
FIG. 7 shows a conceptual view of a pixel group coupled to the demultiplexer shown in FIG. 6.
Figure 8:
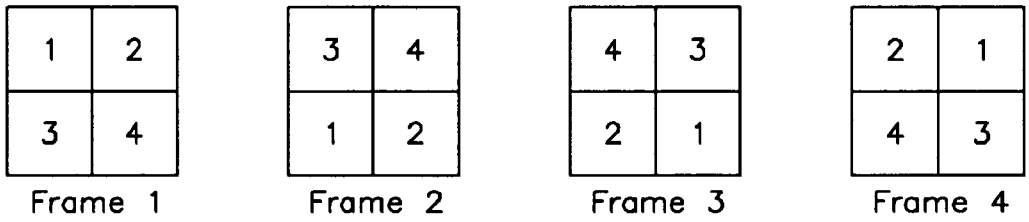
FIG. 8 shows numbers corresponding to the sample/hold circuits that are used for programming currents to the pixels of FIG. 7 in first to fourth frames according to the second exemplary embodiment of the present invention.

Referring now to FIGS. 7 to 10, an operation of the demultiplexer 700 according to the second exemplary embodiment will be described in detail. For ease of description, a conceptual view of four pixels 1*a*, 1*b*, 2*a* and 2*b* that are coupled to the data lines data[1] and data[2] and the scan lines Select[1] and Select[2] are illustrated in FIGS. 7 and 8.

FIG. 7 shows, by way of example, a pixel group coupled to the demultiplexer 700, and FIG. 8 shows numbers that correspond to the sample/hold circuits that are used for programming currents to pixels shown in FIG. 7 according to the second exemplary embodiment of the present invention.

Figure 9A:
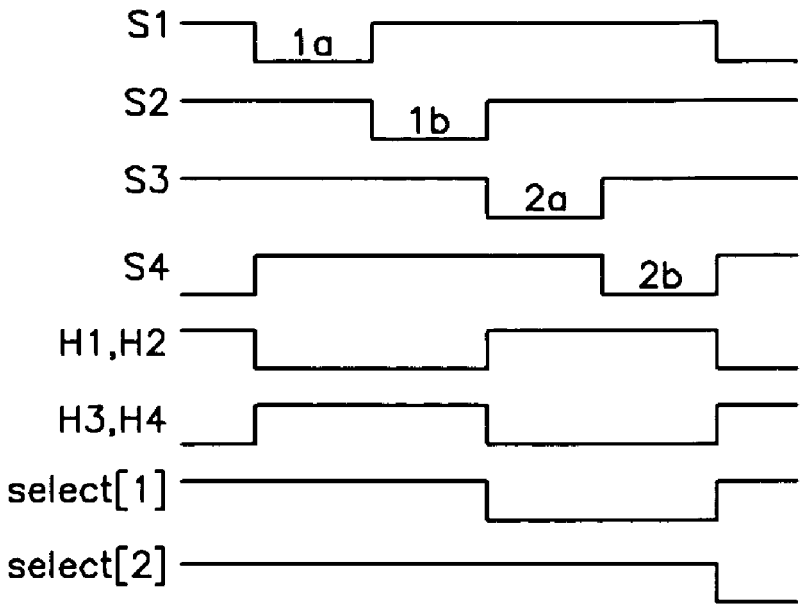
FIGS. 9A to 9D show waveforms of control signals applied to the demultiplexer according to the second exemplary embodiment of the present invention.
Figure 9B:
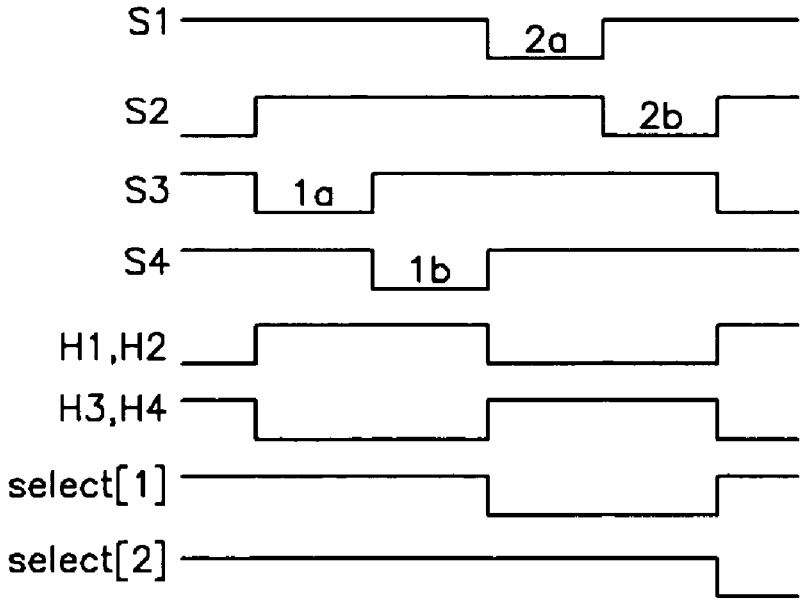
Figure 9C:
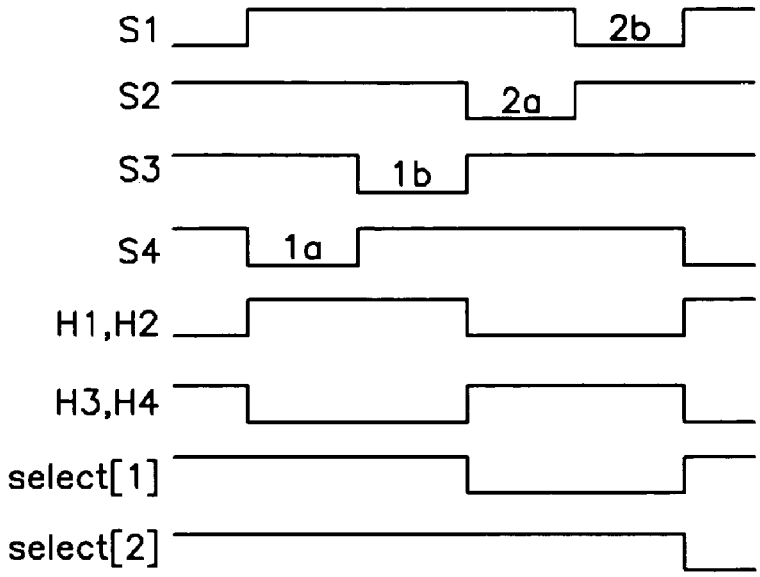
Figure 9D:
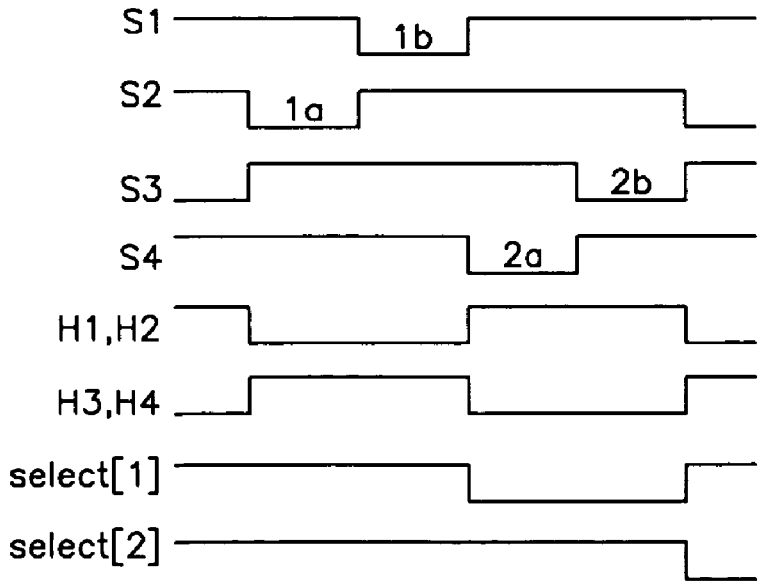
Figure 10:
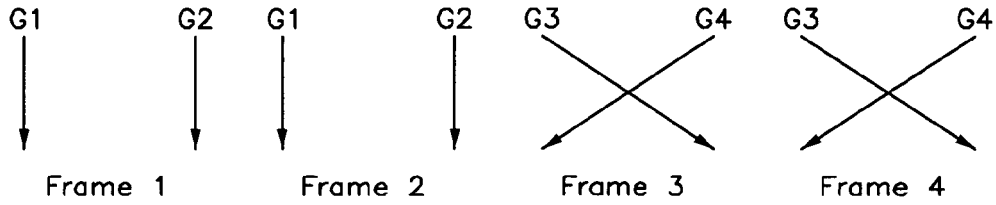
FIG. 10 shows an operation of a switch unit in the first to fourth frames.
Figure 11A:
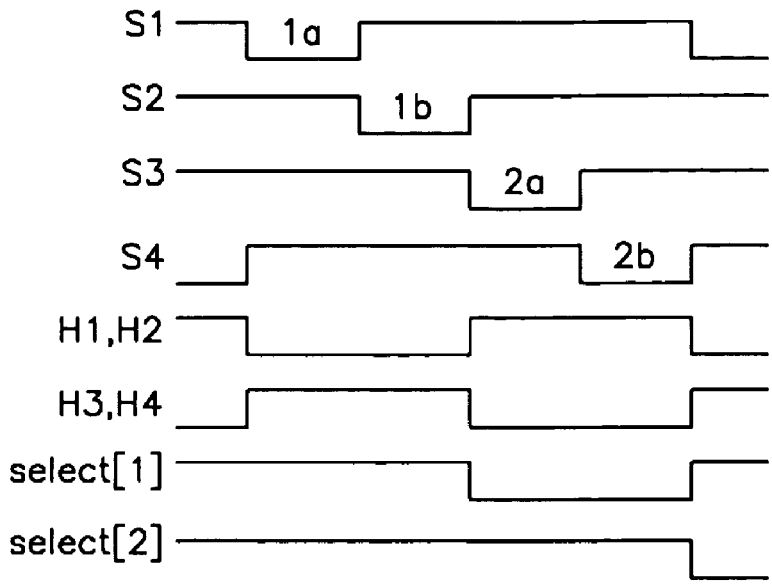
FIGS. 11A to 11D show waveforms of control signals applied to the demultiplexer according to a third exemplary embodiment of the present invention.
Figure 11B:
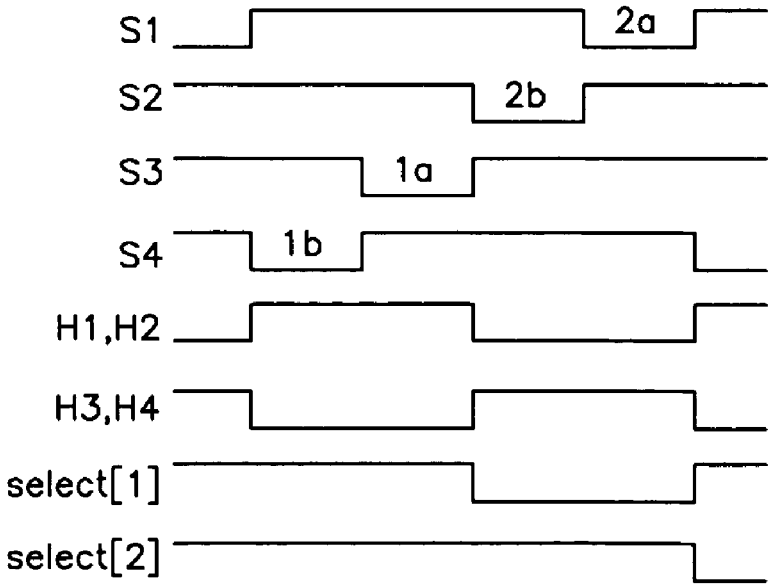
Figure 11C:
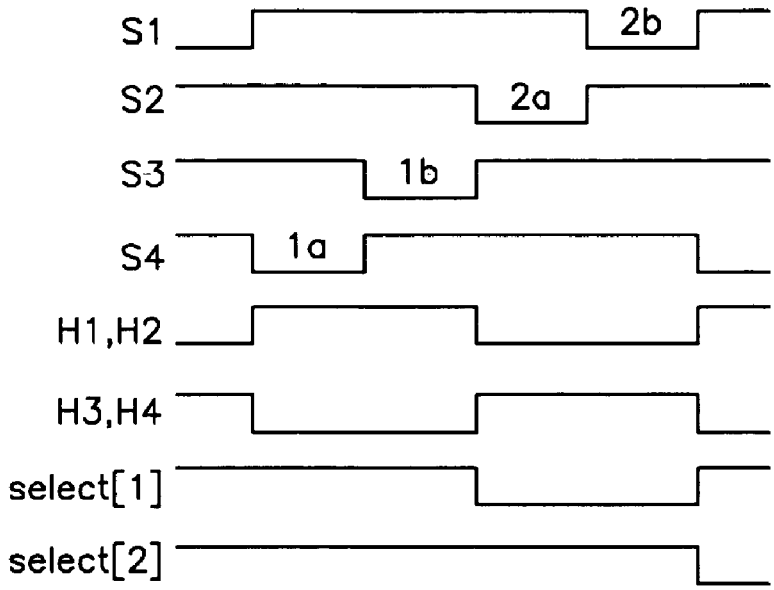
Figure 11D:
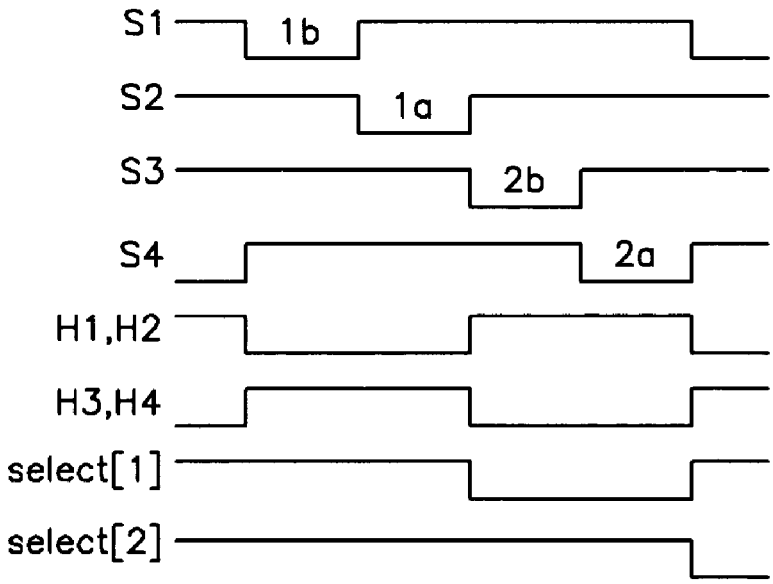

FIGS. 9A to 9D show waveforms of control signals applied to the demultiplexer 700 in the first to fourth frames, and FIG. 10 shows an operation of the switch unit 330 in the first to fourth frames. FIGS. 9A to 9D illustrate the waveforms of the control signals during programming the current to the pixels 1*a*, 1*b*, 1*c* and 1*d*. In FIG. 10, the switches of the switch unit 330 that are turned on for programming in each frame are indicated.

As shown in FIG. 9A, the sampling switches S1, S2, S3, and S4 are sequentially turned on, and the data storage units 31, 32, 33, and 34 sequentially sample the data currents input by the data driver 200 in the first frame. In this instance, since the data driver 200 outputs the data currents in the order of the data currents to be programmed to the pixels 1*a*, 1*b*, 2*a*, and 2*b*, the data storage units 31, 32, 33, and 34 respectively sample the data currents to be programmed to the pixels 1*a*, 1*b*, 2*a*, and 2*b*.

The holding switches H3 and H4 are turned on while the sampling switches S1 and S2 are turned on, but since it is before the select signal Select[1] is applied, no current is held to the data lines data[1] and data[2].

The select signal Select[1] is applied to the pixels 1*a* and 1*b* and the holding switches H1 and H2 are turned on while the sampling switches S3 and S4 are turned on, and hence, the data storage units 31 and 32 hold the currents to the data lines data[1] and data[2] through the switch unit 330.

As can be seen in FIGS. 6 and 10, the switch unit 330 provides the output current of the first sample/hold circuit group 310 to the data line data[1] and provides the output current of the second sample/hold circuit group 320 to the data line data[2] in the first frame.

Therefore, the holding current of the data storage unit 31 is programmed to the pixel 1*a* through the data line data[1], and the holding current of the data storage unit 32 is programmed to the pixel 1*b* through the data line data[2].

After this, an operation (not illustrated) for programming the data current to the pixels 2*a* and 2*b* is performed. In detail, the sampling switches S1 and S2 are sequentially turned on, and the data storage units 31 and 32 sample the data currents. At the same time, the select signal Select[2] is applied and the holding switches H3 and H4 are turned on so that the holding currents of the data storage units 33 and 34 are programmed to the pixels 2*a* and 2*b* through the data lines data[1] and data[2].

Accordingly, the holding current of the first sample/hold circuit is programmed to the pixel 1*a* of the first frame, the holding current of the second sample/hold circuit is programmed to the pixel 1*b*, the holding current of the third sample/hold circuit is programmed to the pixel 2*a*, and the holding current of the fourth sample/hold circuit is programmed to the pixel 2*b*.

As shown in FIG. 9B, the sampling switches S3 and S4 are sequentially turned on, and the sampling switches S1 and S2 are then sequentially turned on in the second frame.

The data storage units 33 and 34 sequentially perform a sampling operation while the sampling switches S3 and S4 are turned on. Further, the data storage units 31 and 32 sequentially perform a sampling operation while the sampling switches S1 and S2 are turned on. Also, the select signal Select[1] is applied and the holding switches H3 and H4 are turned on such that the data storage units 33 and 34 hold the currents to the data lines data[1] and data[2] through the switch unit 330.

In a manner similar to that of the first frame, the switch unit 330 transmits the output current of the first sample/hold circuit group 310 to the data line data[1], and transmits the output current of the second sample/hold circuit group 320 to the data line data[2] in the second frame.

After this, the select signal Select[2] is applied to the pixels 2*a* and 2*b*, and the data storage units 31 and 32 hold the currents corresponding to the sampled data, respectively, to the data lines data[1] and data[2]. Therefore, the holding current of the data storage unit 31 is programmed to the pixel 2*a* through the data line data[1], and the holding current of the data storage unit 32 is programmed to the pixel 2*b* through the data line data[2].

Accordingly, the holding current of the third sample/hold circuit is programmed to the pixel 1*a* of the second frame, the holding current of the fourth sample/hold circuit is programmed to the pixel 1*b*, the holding current of the first sample/hold circuit is programmed to the pixel 2*a*, and the holding current of the second sample/hold circuit is programmed to the pixel 2*b*.

The sampling switches S4, S3, S2, and S1 are sequentially turned on and the data storage units 34, 33, 32, and 31 sequentially sample the data current in the third frame.

The select signal Select[1] is applied to the pixels 1*a* and 1*b* while the sampling switches S2 and S1 are turned on. In this instance, the holding switches H3 and H4 are turned on, and the data storage units 33 and 34 hold the currents to the data lines data[1] and data[2], respectively, through the switch unit 330.

As shown in FIG. 10, the switch unit 330 transmits the output current of the first sample/hold circuit group 310 to the data line data[2] and transmits the output current of the second sample/hold circuit group 320 to the data line data[1] in the third frame.

Therefore, the holding current of the data storage unit 33 is programmed to the data line data[2], and the holding current of the data storage unit 34 is programmed to the data line data[1].

After this, when the select signal Select[2] is applied, the currents which correspond to the sampled data are output to the data storage units 32 and 31, the holding current of the data storage unit 32 is programmed to the pixel 2*a* by the switch unit 330, and the holding current of the data storage unit 31 is programmed to the pixel 2*b*.

Accordingly, the holding current of the fourth sample/hold circuit is programmed to the pixel 1*a* of the third frame, the holding current of the third sample/hold circuit is programmed to the pixel 1*b*, the holding current of the second sample/hold circuit is programmed to the pixel 2*a*, and the holding current of the first sample/hold circuit is programmed to the pixel 2*b*.

The sampling switches S2, S1, S4, and S3 are sequentially turned on and the data storage units 32, 31, 34, and 33 sequentially sample the data current in the fourth frame.

While the sampling switches S4 and S3 are turned on, the select signal Select[1] is applied to the pixels 1*a* and 1*b*. In this instance, the holding switches H1 and H2 are turned on such that the data storage units 31 and 32 hold the currents to the data lines data[1] and data[2] through the switch unit 330.

In a manner similar to that of the third frame, the switch unit 330 provides the output current of the first sample/hold circuit group 310 to the data line data[2] and provides the output current of the second sample/hold circuit group 320 to the data line data[1] in the fourth frame.

Therefore, the holding current of the data storage unit 31 is programmed to the data line data[2], and the holding current of the data storage unit 32 is programmed to the data line data[1].

After this, the select signal Select[2] is applied to the pixels 2*a* and 2*b* and the currents corresponding to the data sampled by the data storage units 33 and 34 are held to the data lines data[2] and data[1] through the switch unit 330. Therefore, the holding current of the data storage unit 34 is programmed to the pixel 2*a*, and the holding current of the data storage unit 33 is programmed to the pixel 2*b*.

Accordingly, the holding current of the second sample/hold circuit is programmed to the pixel 1*a* of the fourth frame, the holding current of the first sample/hold circuit is programmed to the pixel 1*b*, the holding current of the fourth sample/hold circuit is programmed to the pixel 2*a*, and the holding current of the third sample/hold circuit is programmed to the pixel 2*b*.

When the sampling orders of the first to fourth sample/hold circuits are modified and the switch unit 330 switches between the output terminals of the first and second sample/hold circuit groups 310 and 330 and the data lines data[1] and data[2], the first to fourth sample/hold circuits supply the data currents to the pixels 1*a*, 1*b*, 2*a*, and 2*b* the same number of times, and the average of the output currents of the first to fourth sample/hold circuits is supplied to the respective pixels 1*a*, 1*b*, 2*a*, and 2*b*.

However, such a demultiplexing scheme has a problem in that it needs a configuration of four signals to drive the demultiplexer 700. In detail, since the first to fourth sample/hold circuits perform a sampling operation once with reference to the data programmed to the pixel 1*a*, pulses of the control signals are to be applied to the sampling S1 to S4 once. Therefore, the driving circuit for driving the demultiplexer 700 becomes complicated.

Also, the sampling orders of the first to fourth sample/hold circuits are changed in the demultiplexer according to the second exemplary embodiment, but the order of the data input to the demultiplexer 700 from the data driver 200 is fixed to be pixels of 1*a*, 1*b*, 2*a*, and 2*b*. That is, the first sampled output current of the sample/hold circuit is programmed to the pixel 1*a*, the second sampled output current of the sample/hold circuit is programmed to the pixel 1*b*, the third sample output current of the sample/hold circuit is programmed to the pixel 2*a*, and the fourth sample output current of the sample/hold circuit is programmed to the pixel 2*b*.

The data currents to be output to the data line data[1] are sampled in advance in the case of performing 1:2 demultiplexing operation since the data order is fixed to be the pixels of 1*a*, 1*b*, 2*a*, and 2*b*, the data current is concurrently supplied to the pixels 1*a* and 1*b*, and the data current is concurrently supplied to the pixels 2*a* and 2*b*.

It is found from simulation such that the output currents are different according to the sampling orders even when the data currents are sequentially sampled and concurrently held. That is, the output currents become different according to the time difference in the standby stage.

To address this problem, averages of the sampling orders of the data current to be output through the data line data[1] and the data current to be output through the data line data[2] are generated to correspond to each other on the same pixel line in the third exemplary embodiment, so that substantially identical current may be supplied.

That is, the averages of the sampling orders of the first and second sample/hold circuit groups correspond to each other with respect to a single pixel line.

In order to realize this, the corresponding relation of the sample/hold circuits and the pixels per frame is maintained as it is, the data inputting order per frame is changed, and the corresponding sampling order of the sample/hold circuits is changed.

In detail, when the data orders are established to be (1*a*, 1*b*, 2*a*, and 2*b*) and (1*b*, 1*a*, 2*b*, and 2*a*) and repeated, and the corresponding sampling orders of the sample/hold circuits are changed, the configuration of the control signals can be reduced to two signals.

FIGS. 11A to 11D show waveforms of control signals applied to the first to fourth frames according to the third exemplary embodiment of the present invention.

Referring to FIGS. 11A to 11D, an operation of the demultiplexer 700 according to the third exemplary embodiment will be described. No operations of the first and third frames shown in FIGS. 11A and 11C will be described since they are substantially the same as those for the corresponding frames of the second exemplary embodiment.

The data driver 200 sequentially provides the data currents to be programmed to the pixels 1*b*, 1*a*, 2*b*, and 2*a* to the demultiplexer 700 and the sampling switches S4, S3, S2, and S1 of the demultiplexer 700 are sequentially turned on in the second frame.

When the sampling switches S4 and S3 are sequentially turned on, the data storage units 34 and 33 respectively sample the data current to be programmed to the pixels 1*b* and 1*a*.

After this, when the sampling switches S2 and S1 are sequentially turned on, the data storage units 34 and 33 respectively sample the data current to be programmed to the pixels 2*b* and 2*a*. In this instance, the select signal Select[1] is applied and the holding switches H3 and H4 are turned on such that the data storage units 33 and 34 hold the currents to the data lines data[1] and data[2] through the switch unit 330.

Since the operation of the switch unit 330 in the second frame corresponds to that of the second exemplary embodiment, the holding current of the data storage unit 33 is programmed to the pixel 1*a*, and the holding current of the data storage unit 34 is programmed to the pixel 1*b*.

After this, when the holding switches H1 and H2 are turned on, and the select signal Select[2] is applied to the pixels 2*a* and 2*b* (not illustrated), the data storage units 31 and 32 hold the currents corresponding to the sampled data to the data lines data[1] and data[2]. Therefore, the holding current of the data storage unit 31 is programmed to the pixel 2*a*, and the holding current of the data storage unit 32 is programmed to the pixel 2*b*.

Accordingly, the holding current of the third sample/hold circuit is programmed to the pixel 1*a*, the holding current of the fourth sample/hold circuit is programmed to the pixel 1*b*, the holding current of the first sample/hold circuit is programmed to the pixel 2*a*, and the holding current of the second sample/hold circuit is programmed to the pixel 2*b*.

The data driver 200 sequentially provides the data currents to be programmed to the pixels 1*b*, 1*a*, 2*b*, and 2*a* to the demultiplexer 700, and the sampling switches S1, S2, S3, and S4 of the demultiplexer 700 are sequentially turned on in the fourth frame.

When the sampling switches S1 and S2 are sequentially turned on, the data storage units 31 and 32 respectively sample the data current to be programmed to the pixels 1*b* and 1*a*.

After this, when the sampling switches S3 and S4 are sequentially turned on, the data storage units 33 and 34 respectively sample the data current to be programmed to the pixels 2*b* and 2*a*. In this instance, the holding switches H1 and H2 are turned on, and the select signal Select[1] is applied such that the holding currents of the data storage units 31 and 32 are programmed to the data lines data[1] and data[2] through the switch unit 330.

Since the operation of the switch unit 330 in the fourth frame corresponds to that of the second exemplary embodiment, the holding current of the data storage unit 31 is programmed to the pixel 1*b*, and the holding current of the data storage unit 32 is programmed to the pixel 1*a*.

After this, when the holding switches H3 and H4 are turned on, and the select signal Select[2] is applied to the pixels 2*a* and 2*b* (not illustrated), the holding currents of the data storage units 33 and 34 are programmed to the data lines data[1] and data[2] through the switch unit 330, and in detail, the holding current of the data storage unit 34 is programmed to the pixel 2*a*, and the holding current of the data storage unit 33 is programmed to the pixel 2*b*.

Accordingly, the holding current of the second sample/hold circuit is programmed to the pixel 1*a*, the holding current of the first sample/hold circuit is programmed to the pixel 1*b*, the holding current of the fourth sample/hold circuit is programmed to the pixel 2*a*, and the holding current of the third sample/hold circuit is programmed to the pixel 2*b*.

According to the third exemplary embodiment, the configurations of the control signals in the first and fourth frames are the same, the configurations of the control signals in the second and third frames are the same, and hence, the four configurations of the control signals applied to the sampling switches S1, S2, S3, and S4 are reduced to two configurations.

Two data orders of (1*a*, 1*b*, 2*a*, and 2*b*) and (1*b*, 1*a*, 2*b*, and 2*a*) are repeated and the corresponding sampling orders of the sample/hold circuits are modified in the third exemplary embodiment, and various similar modifications are allowable.

For example, the orders of the four frames can be varied differing from the third exemplary embodiment, and the data orders input to the demultiplexer 700 can be modified.

In a fourth exemplary embodiment, the data orders input to the demultiplexer 700 are established to be (1*a*, 1*b*, 2*a*, and 2*b*), (1*b*, 1*a*, 2*b*, and 2*a*), (1*b*, 1*a*, 2*a*, and 2*b*), and (1*a*, 1*b*, 2*b*, and 2*a*), they are sequentially reflected to the first to fourth frames, and the reflection is repeated.

FIGS. 12A to 12D show waveforms of control signals applied to the demultiplexer according to the fourth exemplary embodiment of the present invention.

Referring to FIGS. 12A to 12D, an operation of the demultiplexer 700 according to the fourth exemplary embodiment will be described. The operation of the first and second frames will not be described since they are substantially the same as those for the corresponding frames of the third exemplary embodiment.

Figure 12A:
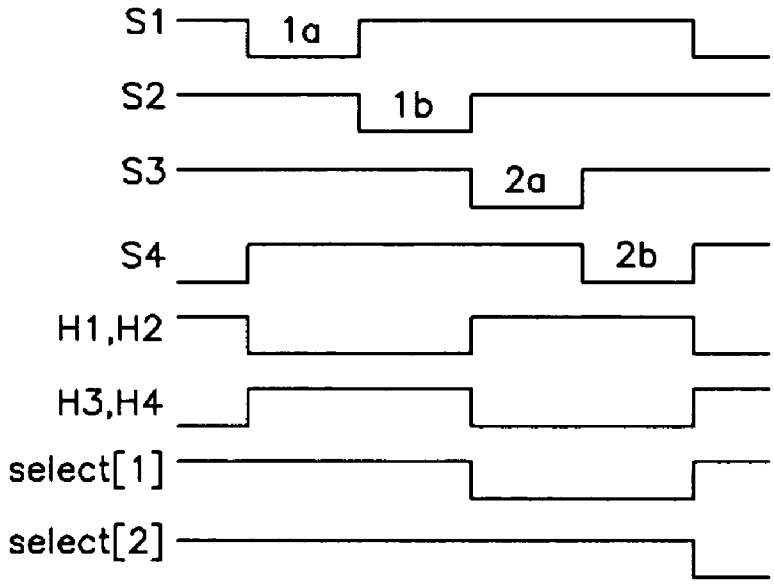
FIGS. 12A to 12D show waveforms of control signals applied to the demultiplexer according to a fourth exemplary embodiment of the present invention.
Figure 12B:
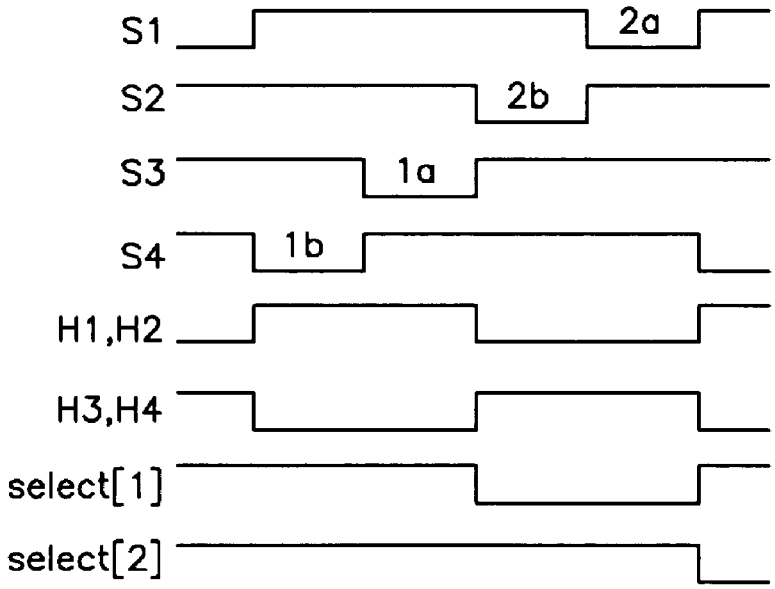
Figure 12C:
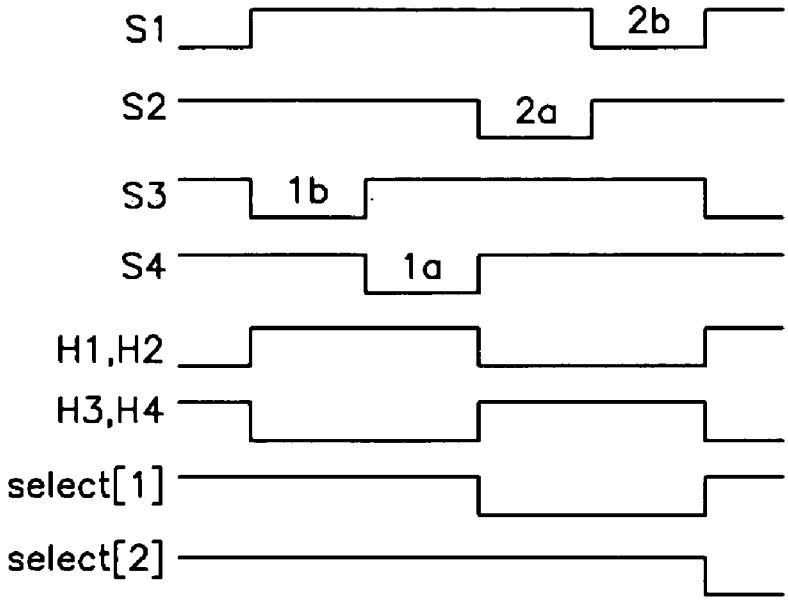

As shown in FIG. 12C, the data driver 200 sequentially provides the data currents corresponding to the pixels 1*b*, 1*a*, 2*a*, and 2*b* to the demultiplexer 700 and the sampling switches S3, S4, S2, and S1 of the demultiplexer 700 are sequentially turned on in the third frame.

When the sampling switches S4 and S3 are sequentially turned on, the data storage units 34 and 33 respectively sample the data current to be programmed to the pixels 1*b* and 1*a*.

After this, when the sampling switches S2 and S1 are sequentially turned on, the data storage units 32 and 31 respectively sample the data current to be programmed to the pixels 2*a* and 2*b*. In this instance, the select signal Select[1] is applied and the holding switches H3 and H4 are turned on such that the holding currents of the data storage units 33 and 34 are programmed to the data lines data[1] and data[2] through the switch unit 330.

Since the operation of the switch unit 330 in the third frame is substantially the same as that of the second exemplary embodiment, the holding current of the data storage unit 33 is programmed to the pixel 1*b*, and the holding current of the data storage unit 34 is programmed to the pixel 1*a*.

After this, when the select signal Select[2] is applied to the pixels 2*a* and 2*b* and the holding switches H1 and H2 are turned on (not illustrated), the currents corresponding to the data sampled to the data storage units 31 and 32 are held to the data lines data[1] and data[2]. Therefore, the holding current of the data storage unit 31 is programmed to the pixel 2*b*, and the holding current of the data storage unit 32 is programmed to the pixel 2*a*.

Accordingly, the holding current of the fourth sample/hold circuit is programmed to the pixel 1*a*, the holding current of the third sample/hold circuit is programmed to the pixel 1*b*, the holding current of the second sample/hold circuit is programmed to the pixel 2*a*, and the holding current of the first sample/hold circuit is programmed to the pixel 2*b*.

Figure 12D:
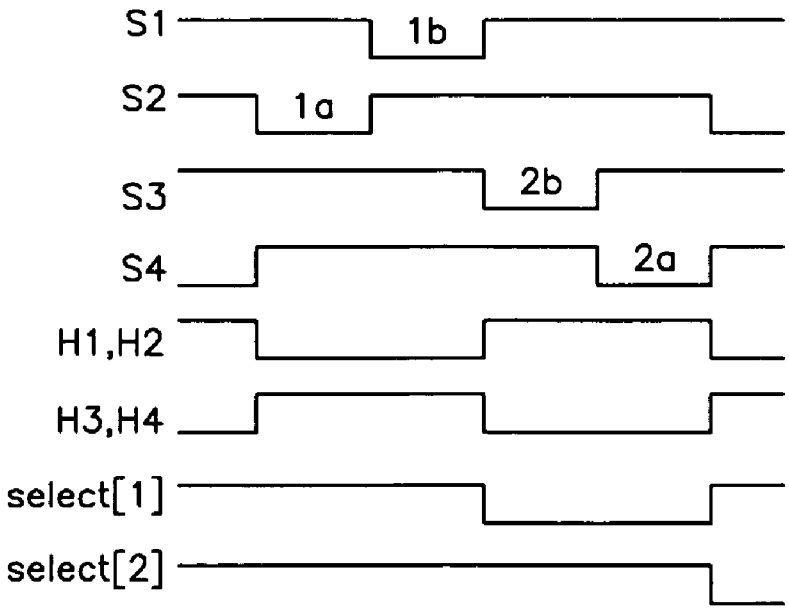

As shown in FIG. 12D, the data driver 200 sequentially provides the data currents corresponding to the pixels 1*a*, 1*b*, 2*b*, and 2*a* to the demultiplexer 700 and the sampling switches S2, S1, S3, and S4 of the demultiplexer 700 are sequentially turned on in the fourth frame.

When the sampling switches S2 and S1 are sequentially turned on, the data storage units 32 and 31 respectively sample the data current to be programmed to the pixels 1*a* and 1*b*.

After this, when the sampling switches S3 and S4 are sequentially turned on, the data storage units 33 and 34 respectively sample the data current to be programmed to the pixels 2*b* and 2*a*. At the same time, the select signal Select[1] is applied and the holding switches H1 and H2 are turned on such that the holding currents of the data storage units 31 and 32 are programmed to the data lines data[1] and data[2] through the switch unit 330.

Since the operation of the switch unit 330 in the third frame corresponds to that of the second exemplary embodiment, the holding current of data storage unit 31 is programmed to the pixel 1*b*, and the holding current of data storage unit 32 is programmed to the pixel 1*a*.

After this, when the select signal Select[2] is applied to the pixels 2*a* and 2*b* and the holding switches H3 and H4 are turned on (not illustrated), the sampling currents of the data storage units 33 and 34 are held to the data lines data[1] and data[2]. Therefore, the holding current of the data storage unit 33 is programmed to the pixel 2*b*, and the holding current of the data storage unit 34 is programmed to the pixel 2*a*.

Accordingly, the holding current of the second sample/hold circuit is programmed to the pixel 1*a*, the holding current of the first sample/hold circuit is programmed to the pixel 1*b*, the holding current of the fourth sample/hold circuit is programmed to the pixel 2*a*, and the holding current of the third sample/hold circuit is programmed to the pixel 2*b*.

In the third and fourth exemplary embodiments, the data orders input to the demultiplexer 700 is modified to reduce the four configurations of the control signals to two configurations.

However, a driving circuit for modifying the control signals according to the frames is required even when the configurations of the control signals are two.

In a fifth exemplary embodiment, the respective switches of the demultiplexer are controlled by using clock signals without an additional driving circuit for generating different control signals applied to the demultiplexer 700 for each frame.

In detail, when the periods of the sampling clock signals and the holding clock signals are established to be double the horizontal period T, and the vertical period is established to be an odd number of the horizontal periods T, the phase is shifted by 180° for each frame, and the effect of two control signal configurations is obtained.

Figure 13:
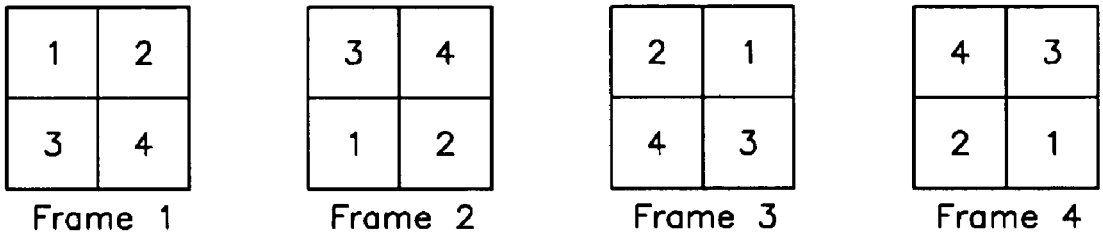
FIG. 13 shows numbers of sample/hold circuits for programming currents to pixels in first to fourth frames according to a fifth exemplary embodiment of the present invention.

In order to configure the control signals with the clock signals in the fifth exemplary embodiment, the first and second sample/hold circuits and the third and fourth sample/hold circuits alternately supply the data currents to the pixels 1*a* and 1*b* for each frame, and the orders of the third and fourth frames are modified as shown in FIG. 13.

Figure 14:
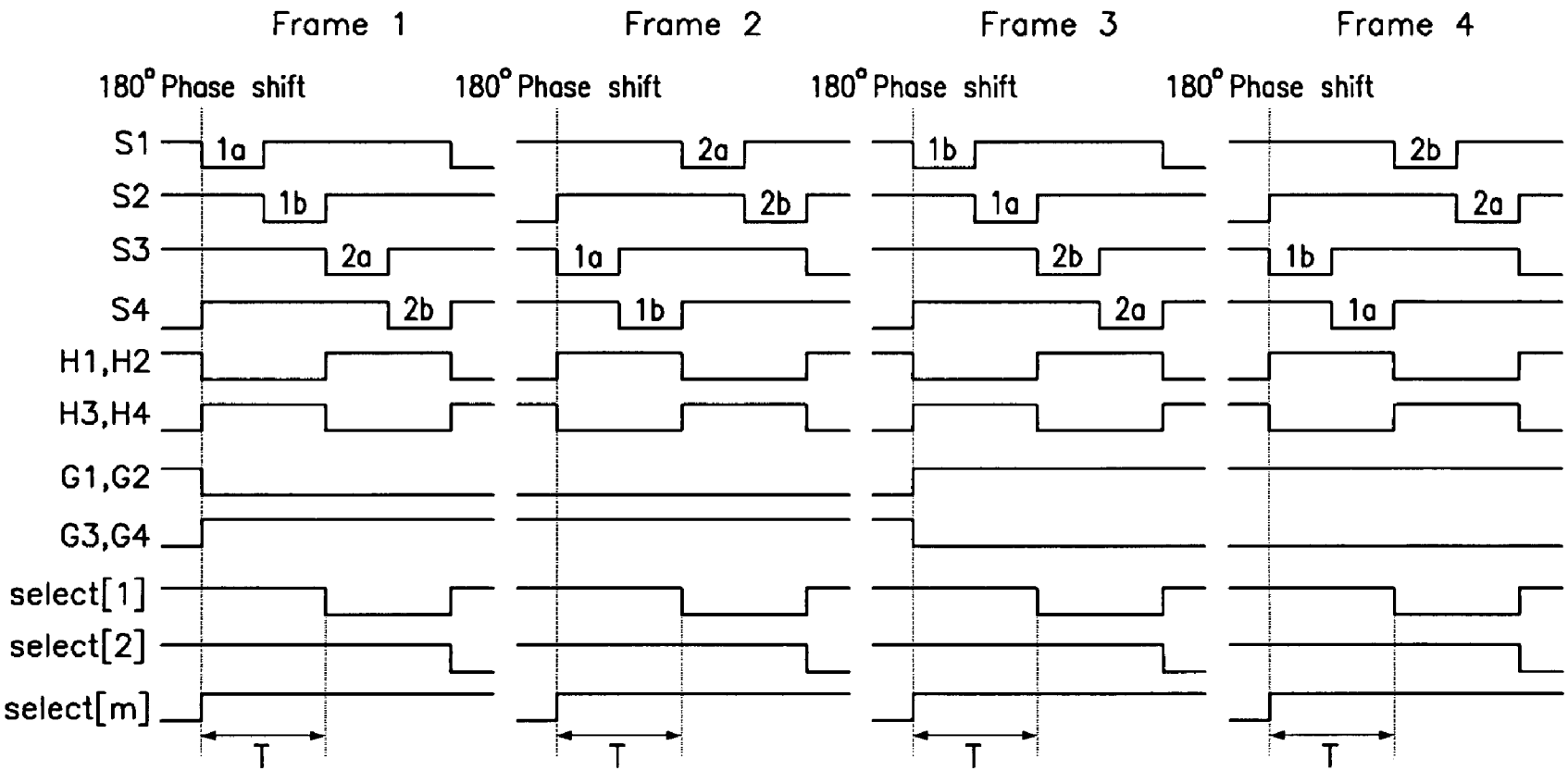
FIG. 14 shows waveforms of control signals applied to the demultiplexer according to the fifth exemplary embodiment of the present invention.

FIG. 13 shows numbers that correspond to the sample/hold circuits used for programming currents to the pixels 1*a*, 1*b*, 2*a*, and 2*b* according to the fifth exemplary embodiment of the present invention, and FIG. 14 shows waveforms of control signals applied to the demultiplexer 700.

As shown in FIGS. 13 and 14, no operations of the demultiplexer for the respective frames will be described since the operations of the first and second frames correspond to the operations of the first and second frames in the second exemplary embodiment, the operation of the third frame is substantially the same as the operation of the fourth frame in the third exemplary embodiment, and the operation of the fourth frame is substantially the same as the operation of the third frame in the fourth exemplary embodiment.

Also, when the phase is shifted by 180° for each frame, and the orders of the data currents input to the demultiplexer are modified as shown in FIG. 14, the control signals applied to the first to fourth sample/hold circuits can be generated with the clock signals without any driving circuits. That is, when 4-phase clock signals (referred to as sampling clock signals hereinafter) are used for the control signals applied to the sampling switches S1, S2, S3, and S4, and 2-phase clock signals (referred to as holding clock signals hereinafter) are used for the control signals applied to the holding switches H1, H2, H3, and H4, the sampling orders of the first to fourth sample/hold circuits are established to be the same on average.

Referring now to FIG. 14, "m" of the scan line select[m] is an even number, and the period of a single frame is defined as (m+1) horizontal periods.

In this instance, intervals of pulse widths and pulses of the clock signals can be varied depending on the embodiments, the order of the first and third frames can be modified, and the order of the fourth and second frames can be modified.

The 1:2 multiplexer has been described for ease of description, and without being restricted to this, various 1:N demultiplexers can be realized by using the scope of the present invention.

Also, the orders of the first to fourth sample/hold circuits programmed to the pixels or the data programming orders have been modified per frame, and these operations can be executed per subframe.

While this invention has been described in connection with certain exemplary embodiments, it is to be understood that the present invention is not limited to the disclosed embodiments, but, on the contrary, is intended to cover various modifications and equivalent arrangements included within the spirit and scope of the appended claims, and equivalents thereof.

What is claimed is:

1. A display device including a plurality of data lines, a plurality of scan lines for transmitting select signals, and a plurality of pixel circuits coupled to the data lines and the scan lines, comprising:

a data driver for supplying data currents corresponding to image signals;

a demultiplexer including first and second sample/hold circuit groups having input terminals coupled to the data driver, each said sample/hold circuit group including at least two sample/hold circuits;

a switch unit for switching between output terminals of the first and second sample/hold circuit groups and the data lines; and a scan driver for supplying the select signals to the scan lines, wherein one of the sample/hold circuits of the first sample/hold circuit group samples a corresponding one of the data currents during at least a part of a period in which another one of the sample/hold circuits of the first sample/hold circuit group outputs a current to the switch unit, wherein one of the sample/hold circuits of the second sample/hold circuit group samples a corresponding one of the data currents during at least a part of a period in which another one of the sample/hold circuits of the second sample/hold circuit group outputs a current to the switch unit, wherein orders in which the data currents are supplied from the data driver are varied, and wherein the switch unit programs the output currents of the first and second sample/hold circuit groups, respectively, to first and second data lines from among the data lines in one frame, and programs the output currents of the first and second sample/hold circuit groups, respectively, to the second and first data lines from among the data lines in another frame.

2. The display device of claim 1, wherein the sample/hold circuits of the first sample/hold circuit group include first and third sample/hold circuits each having an input terminal and an output terminal, wherein the input terminals of the first and third sample/hold circuits are coupled with each other, and the output terminals of the first and third sample/hold circuits are coupled with each other, and wherein the sample/hold circuits of the second sample/hold circuit group include second and fourth sample/hold circuits each having an input terminal and an output terminal, wherein the input terminals of the second and fourth sample/hold circuits are coupled with each other, and the output terminals of the second and fourth sample/hold circuits are coupled with each other.

3. The display device of claim 2, wherein the first and second sample/hold circuits sequentially sample the data currents during a first period to store as first sampled data, and output currents corresponding to the first sampled data during a second period, and wherein the third and fourth sample/hold circuits sequentially sample the data currents during the second period to store as second sampled data, and output currents corresponding to the second sampled data during a third period.

4. The display device of claim 3, wherein the first and third periods substantially overlap each other.

5. The display device of claim 4, wherein an operation of the first period is performed before an operation of the second period in one frame, and the operation of the second period is performed before the operation of the first period in another frame.

6. The display device of claim 3, wherein sampling orders of the first and second sample/hold circuits are established differently in at least two different frames.

7. The display device of claim 6, wherein sampling orders of the third and fourth sample/hold circuits are established differently in at least two different frames.

8. The display device of claim 3, wherein the switch unit programs the output currents of the first and second sample/hold circuits to at least two said data lines during the second period, and programs the output currents of the third and fourth sample/hold circuits to at least two said data lines during the third period.

9. The display device of claim 3, wherein each of the first, second, third and fourth sample/hold circuits comprises:

a data storage unit for sampling input currents to store as the sampled data, and holding currents corresponding to the sampled data;

a sampling switch for transmitting the data currents to the data storage unit in response to a first control signal; and a holding switch for applying a holding current of the data storage unit to the switch unit in response to a second control signal.

10. The display device of claim 9, wherein the first and second control signals are realized with clock signals.

11. The display device of claim 1, wherein the orders of the data currents input to the demultiplexer are varied per frame and have predetermined periods.

12. The display device of claim 1, wherein the orders of the data currents input to the demultiplexer are varied per subframe and have predetermined periods.

13. The display device of claim 1, wherein sampling orders of the currents to be programmed to the pixel circuits are the same on average.

14. The display device of claim 1, wherein the supplying orders of the data currents to be programmed to the pixel circuits from the data driver are the same on average.

15. A display device including a plurality of data lines, a plurality of scan lines for transmitting select signals, and a plurality of pixel circuits coupled to the data lines and the scan lines, comprising:

a data driver for supplying data currents corresponding to image signals;

a demultiplexer including first and second sample/hold circuit groups having input terminals coupled to the data driver, each said sample/hold circuit group including at least two sample/hold circuits;

a switch unit for switching between output terminals of the first and second sample/hold circuit groups and the data lines; and a scan driver for supplying the select signals to the scan lines, wherein one of the sample/hold circuits of the first sample/hold circuit group samples a corresponding one of the data currents during at least a part of a period in which another one of the sample/hold circuits of the first sample/hold circuit group outputs a current to the switch unit, wherein one of the sample/hold circuits of the second sample/hold circuit group samples a corresponding one of the data currents during at least a part of a period in which another one of the sample/hold circuits of the second sample/hold circuit group outputs a current to the switch unit, wherein orders in which the data currents are supplied from the data driver are varied, wherein the sample/hold circuits of the first sample/hold circuit group include first and third sample/hold circuits each having an input terminal and an output terminal, wherein the input terminals of the first and third sample/hold circuits are coupled with each other, and the output terminals of the first and third sample/hold circuits are coupled with each other, wherein the sample/hold circuits of the second sample/hold circuit group include second and fourth sample/hold circuits each having an input terminal and an output terminal, wherein the input terminals of the second and fourth sample/hold circuits are coupled with each other, and the output terminals of the second and fourth sample/hold circuits are coupled with each other wherein the first and second sample/hold circuits sequentially sample the data currents during a first period to store as first sampled data, and output currents corresponding to the first sampled data during a second period, wherein the third and fourth sample/hold circuits sequentially sample the data currents during the second period to store as second sampled data, and output currents corresponding to the second sampled data during a third period, wherein each of the first, second, third and fourth sample/hold circuits comprises:

a data storage unit for sampling input currents to store as the sampled data, and holding currents corresponding to the sampled data;

a sampling switch for transmitting the data currents to the data storage unit in response to a first control signal; and a holding switch for applying a holding current of the data storage unit to the switch unit in response to a second control signal, wherein the first and second control signals are realized with clock signals, and wherein the first control signal is realized with 4-phase clock signals, and the second control signal is realized with 2-phase clock signals.

16. The display device of claim 15, wherein when a half of horizontal periods of the first and second control signals is defined to be the first period, and a vertical period of the first and second control signals is odd-number times the first period.

17. The display device of claim 16, wherein the phases of the first and second control signals are shifted by 180° for each frame.

18. A display device including a plurality of data lines, a plurality of scan lines for transmitting select signals, and a plurality of pixel circuits coupled to the data lines and the scan lines, comprising:

a data driver for supplying data currents corresponding to image signals;

a demultiplexer including first and second sample/hold circuit groups having input terminals coupled to the data driver, each said sample/hold circuit group including at least two sample/hold circuits;

a switch unit for switching between output terminals of the first and second sample/hold circuit groups and the data lines; and a scan driver for supplying the select signals to the scan lines, wherein one of the sample/hold circuits of the first sample/hold circuit group samples a corresponding one of the data currents during at least a part of a period in which another one of the sample/hold circuits of the first sample/hold circuit group outputs a current to the switch unit, wherein one of the sample/hold circuits of the second sample/hold circuit group samples a corresponding one of the data currents during at least a part of a period in which another one of the sample/hold circuits of the second sample/hold circuit group outputs a current to the switch unit, wherein orders in which the data currents are supplied from the data driver are varied, wherein the sample/hold circuits of the first sample/hold circuit group include first and third sample/hold circuits each having an input terminal and an output terminal, wherein the input terminals of the first and third sample/ hold circuits are coupled with each other, and the output terminals of the first and third sample/hold circuits are coupled with each other, wherein the sample/hold circuits of the second sample/hold circuit group include second and fourth sample/hold circuits each having an input terminal and an output terminal, wherein the input terminals of the second and fourth sample/hold circuits are coupled with each other, and the output terminals of the second and fourth sample/hold circuits are coupled with each other, and wherein each of the first, second, third and fourth sample/hold circuits comprises:

a transistor having a first terminal, a second terminal, and a third terminal, and controlling a current flowing to the third terminal from the second terminal according to a voltage difference between the first and second terminals;

a first switch for coupling a first power source to the second terminal of the transistor in response to a first control signal;

a second switch for transmitting the corresponding one of the data currents to the first terminal of the transistor in response to a second control signal;

a third switch for diode-connecting the transistor in response to a third control signal;

a capacitor, coupled between the first and second terminals of the transistor, for storing a voltage corresponding to the corresponding one of the data currents;

a fourth switch for coupling a second power source to the third terminal of the transistor in response to a fourth control signal; and a fifth switch for holding a current corresponding to the voltage stored in the capacitor to the second terminal of the transistor.

19. The display device of claim 18, wherein the first, second and third switches respond to a sampling operation, and the fourth and fifth switches respond to a holding operation.

20. The display device of claim 18, wherein the first, second and third switches are realized with transistors having the same channel type, and the first, second and third control signals are substantially the same as each other.

21. The display device of claim 20, wherein the fourth and fifth switches are realized with transistors having the same channel type, and the fourth and fifth control signals are substantially the same as each other.

22. A display device including a plurality of data lines a plurality of scan lines for transmitting select signals, and a plurality of pixel circuits coupled to the data lines and the scan lines and comprising a first pixel circuit and a second pixel circuit, the display device comprising:

a data driver for supplying data currents corresponding to image signals to be displayed during a plurality of frames, each of the frames comprising at least a first time period followed by a second time period, the data driver being configured to vary an order in which the data currents are supplied to the plurality of pixel circuits, such that in one of the frames the data driver supplies the data current for the first pixel circuit in the first time period and supplies the data current for the second pixel circuit in the second time period, and in another one of the frames, the data driver supplies the data current for the second pixel circuit in the first time period and supplies the data current for the first pixel circuit in the second time period;

a demultiplexer having an input terminal coupled to the data driver, and demultiplexing the data currents to output as demultiplexed data currents;

a switch unit for switching between an output terminal of the demultiplexer and the data lines; and a scan driver for supplying the select signals to the scan lines, the switch unit is switched so that the demultiplexed data currents are programmed to corresponding said pixel circuits.

23. The display device of claim 22, wherein the demultiplexer comprises:

a first sample/hold circuit group including first and third sample/hold circuits each having an input terminal and an output terminal, wherein the input terminals are coupled with each other, and the output terminals are coupled with each other, and a second sample/hold circuit group including second and fourth sample/hold circuits each having an input terminal and an output terminal, wherein the input terminals are coupled with each other, and the output terminals are coupled with each other.

24. The display device of claim 23, wherein the first and second sample/hold circuits sequentially sample the data currents during a first period to store as first sampled data, and output currents corresponding to the first sampled data during a second period, and wherein the third and fourth sample/hold circuits sequentially sample the data currents during the second period to store as second sampled data, and output currents corresponding to the second sampled data during a third period.

25. The display device of claim 24, wherein the first and third periods substantially overlap each other.

26. The display device of claim 24, wherein an order of the data currents sampled by the demultiplexer is different in at least two different frames among the plurality of frames.

27. The display device of claim 23, wherein sampling orders of the currents to be programmed to the pixel circuits through the data lines are the same on average.

28. The display device of claim 23, wherein each of the first, second, third and fourth sample/hold circuits comprises:

a data storage unit for sampling input currents to store as the sampled data, and holding currents corresponding to the sampled data;

a sampling switch for transmitting the data currents to the data storage unit in response to a first control signal; and a holding switch for applying a holding current of the data storage unit to the switch unit in response to a second control signal.

29. The display device of claim 28, wherein the first and second control signals are realized with clock signals.

30. The display device of claim 29, wherein when a half of horizontal periods of the first and second control signals is defined to be a first period, a vertical period of the first and second control signals is odd-number times the first period.

31. The display device of claim 30, wherein the phases of the first and second control signals are shifted by 180° for each frame.

32. A display device including a plurality of data lines, a plurality of scan lines for transmitting select signals, and a plurality of pixel circuits coupled to the data lines and the scan lines, comprising:

a data driver for supplying data currents corresponding to image signals;

a demultiplexer having an input terminal coupled to the data driver, and demultiplexing the data currents to output as demultiplexed data currents;

a switch unit for switching between an output terminal of the demultiplexer and the data lines; and a scan driver for supplying the select signals to the scan lines, wherein orders of the data currents supplied from the data driver are established differently in at least two different frames, and the switch unit is switched so that the demultiplexed data currents are programmed to corresponding said pixel circuits, wherein the demultiplexer comprises:

a first sample/hold circuit group including first and third sample/hold circuits each having an input terminal and an output terminal, wherein the input terminals are coupled with each other, and the output terminals are coupled with each other, and a second sample/hold circuit group including second and fourth sample/hold circuits each having an input terminal and an output terminal, wherein the input terminals are coupled with each other, and the output terminals are coupled with each other, wherein each of the first, second, third and fourth sample/hold circuits comprises:

a data storage unit for sampling input currents to store as the sampled data, and holding currents corresponding to the sampled data;

a sampling switch for transmitting the data currents to the data storage unit in response to a first control signal; and a holding switch for applying a holding current of the data storage unit to the switch unit in response to a second control signal, wherein the first and second control signals are realized with clock signals, and wherein the first control signal is realized with 4-phase clock signals, and the second control signal is realized with 2-phase clock signals.

33. A demultiplexer for programming time-divided, input data currents to at least two signal lines, comprising:

first and second sample/hold circuit groups each having an input terminal coupled to a data driver, and demultiplexing the input data currents to output as demultiplexed currents; and a switch unit for switching between output terminals of the first and second sample/hold circuit groups and the signal lines, wherein the first sample/hold circuit group includes first and third sample/hold circuits each having an input terminal and an output terminal, wherein the input terminals of the first and third sample/hold circuits are coupled with each other, and the output terminals of the first and third sample/hold circuits are coupled with each other, and wherein the second sample/hold circuit group includes second and fourth sample/hold circuits each having an input terminal and an output terminal, wherein the input terminals of the second and fourth sample/hold circuits are coupled with each other, and the output terminals of the second and fourth sample/hold circuits are coupled with each other, wherein sampling orders of the first, second, third and fourth sample/hold circuits are varied according to orders of the input data currents, and wherein the switch unit programs the demultiplexed currents of the first and second sample/hold circuit groups, respectively, to first and second signal lines from among the signal lines in one period, and programs the demultiplexed currents of the first and second sample/hold circuit groups, respectively, to the second and first signal lines from among the signal lines in another period.

34. The demultiplexer of claim 33, wherein the first and second sample/hold circuits sequentially sample the input data currents to store as first sampled data during a first period, and output currents corresponding to the first sampled data during a second period, and the third and fourth sample/hold circuits sequentially sample the data currents to store as second sampled data during the second period, and output currents corresponding to the second sampled data during a third period.

35. The demultiplexer of claim 34, wherein the first and third periods substantially overlap each other.

36. A demultiplexing method for outputting time-divided and sequentially input data currents to at least two signal lines, during a plurality of periods, each of the periods comprising at least a first sub-period followed by a second sub-period, the input data currents comprising at least a first input data current and a second input data current, the method comprising:

allowing first and second sample/hold circuits to sequentially sample the input data currents to store as first sampled data in a predetermined order during a first period;

allowing the first and second sample/hold circuits to hold a current corresponding to the first sampled data to the signal lines, and allowing third and fourth sample/hold circuits to sample the input data currents to store as second sampled data during a second period; and allowing the third and fourth sample/hold circuits to hold a current corresponding to the second sampled data to the signal lines during a third period, wherein orders in which the input data currents are input to be demultiplexed are varied, such that in one of the periods, the first input data current is supplied in the first sub-period and the second input data current is supplied in the second sub-period, and in another one of the periods, the second input data current is supplied in the first sub-period and the first input data current is supplied in the second sub-period.

37. The demultiplexing method of claim 36, wherein the plurality of periods are a plurality of frames, and sampling orders of the first and second sample/hold circuits are different in at least two different ones of the frames.

38. The demultiplexing method of claim 36, wherein the plurality of periods are a plurality of frames, and sampling orders of the third and fourth sample/hold circuits are different in at least two different ones of the frames.

39. The demultiplexing method of claim 36, wherein orders for the first, second, third and fourth sample/hold circuits to sample the input data currents correspond to each other on average.

* * * * *

UNITED STATES PATENT AND TRADEMARK OFFICE

CERTIFICATE OF CORRECTION

PATENT NO. : 7,468,718 B2
APPLICATION NO. : 10/971177
DATED : December 23, 2008
INVENTOR(S) : Dong-Yong Shin It is certified that error appears in the above-identified patent and that said Letters Patent is hereby corrected as shown below:

In the Claims

| | |
|---|---|
| Column 17, line 46, Claim 22 | After "lines",<br>Insert --,-- |
| Column 18, line 5, Claim 22 | Before "the",<br>Insert --wherein-- |

Signed and Sealed this

Second Day of June, 2009

JOHN DOLL
*Acting Director of the United States Patent and Trademark Office*